US005088891A

United States Patent [19]

Brown et al.

[11] Patent Number: 5,088,891

[45] Date of Patent: Feb. 18, 1992

[54] PUMP WITH SEAL COOLING MEANS

[75] Inventors: Robert W. Brown; John M. Taylor, both of Cathcart, Glasgow, Scotland

[73] Assignee: Weir Pumps Ltd., Glasgow, Scotland

[21] Appl. No.: 514,625

[22] Filed: Apr. 25, 1990

[30] Foreign Application Priority Data

Apr. 26, 1989 [GB] United Kingdom ..... 8909504

[51] Int. Cl.[5] ..... F04D 29/58

[52] U.S. Cl. ..... 415/176; 415/175

[58] Field of Search ..... 415/110, 111, 112, 168.1, 415/175, 176

[56] References Cited

U.S. PATENT DOCUMENTS

Re. 30,333 7/1980 Gordon, Jr. et al. ..... 415/175
2,853,020 9/1958 Hollinger et al. ..... 415/175
3,574,473 4/1971 Gaffal ..... 415/175
3,600,101 8/1971 Oglesby et al. ..... 415/175
4,690,612 9/1987 Jenkins ..... 415/176

FOREIGN PATENT DOCUMENTS 803306 10/1958 United Kingdom ..... 415/175

*Primary Examiner*—Edward K. Look
*Assistant Examiner*—James A. Larson
*Attorney, Agent, or Firm*—Pennie & Edmonds

[57] ABSTRACT

A pump for high temperature liquid includes a duct interconnecting the suction inlet space, and the annular clearance space between the shaft and the pressure housing at a point immediately adjacent to the seal around the shaft. During hot stand-by uniform thermo-syphon circulation of liquid occurs from the suction inlet space through the annular clearance space and back to the suction inlet via the duct, which helps prevent thermal stresses being set up in the shaft.

12 Claims, 2 Drawing Sheets

PUMP WITH SEAL COOLING MEANS

BACKGROUND OF THE INVENTION

The present invention relates to a pump for high temperature liquid, particularly a boiler feed pump for pumping high temperature water to a boiler, which has a rotary seal having cooling means to keep the seal temperature within its recommended range.

Boiler feed pumps for power stations typically pump water at elevated temperatures (150° centigrade and greater) and at elevated pressures. Such pumps are usually driven by turbines or electric motors. The pump has a number of impellers on a driven shaft which progressively pressurize the feed water up to pressures of typically 150 to 300 bar. The shaft is provided with rotary mechanical seals at either end, sealing the shaft into the pump housing. These seals, however, require cooling in order to operate satisfactorily and have a reasonable lifetime.

In the past, the seals have been cooled by means of a cooling jacket located inboard of the seals through which coolant is passed from an external source. Additionally the seal is commonly cooled by means of a closed loop cooling circuit. By this means, boiler pump water within the space occupied by the mechanical seal is pumped through a cooler by means of a pumping ring mounted on the shaft. Thus the temperature of the seal is kept lower than the rest of the pump whilst the pump is running.

When the pump is at rest, there is still a requirement to maintain the mechanical seals at a lower temperature than the rest of the pump. This is effected by continuing to circulate coolant through the aforesaid cooling jacket augmented by circulation of boiled feed pump water within the closed cooling loop by means of natural convection.

The temperature differentials arising, during this hot standby condition, from the need to cool the mechanical seal result in vigorous convection currents being set up in the annular space between the space and the cooling jacket inboard of the seal. This condition leads to local thermal distortion of the stationary shaft, which tends to become bowed.

Thermal bowing of the shaft has certain undesirable consequences. Firstly, there may be premature wear of internal clearances when a pump on on hot standby is started. Secondly, on a turbine driven pump being subjected to low speed barring operations, the friction torque, or even seizure, that develops when barring is discontinued for any reason can be sufficient to prevent reinstatement of barring. At the least, it will take several hours for the pump and its contents to cool sufficiently to permit barring reinstatement. Thirdly, the bowed shaft gives rise to mechanical imbalance and vibration on start up which will persist until the shaft temperature becomes uniform. Fourthly, the equalibrating forces between the thermally bowed shaft and constraining internal and journal bearing clearances give rise to orbital motion of the shaft journals within the bearings. This condition can result in the pump being tripped out if shaft displacement safety sensors are installed.

For these reasons, it is desirable to reduce or eliminate the thermally induced bowing of the shaft during hot standby.

Several attempts have been made to do this in the past. On turbine driven pumps, a barring mechanism is provided which continually rotates the shaft at a slow speed during hot standby. This is a requirement of the turbine itself. However, there are significant control problems if barring gear is fitted to electric motor driven pumps where motor start up is automatic. Then, special provision must be made to disengage the barring gear as part of the start up sequence and this involves the additional risk of wrecked barring gear should disengagement fail to take place.

Another approach to this problem has been to inject hot boiler feed water from other operational pumps directly into the annular space between the shaft and housing of the pump on hot standby. This inhibits the convection currents which lead to bowing of the shaft. However, the effect of this is to maintain the seal area at an undesirably high temperature resulting in premature deterioration. Cooler water from another source could be injected to overcome this problem but the resulting additional equipment and complexity involved is undesirable.

SUMMARY OF THE INVENTION

It is an object of the present invention to mitigate these problems in a simple and effective manner.

Thus, the present invention provides a pump suitable for high temperature liquid, comprising:

- a pressure housing having a suction inlet and a discharge for the liquid being pumped;
- a driven shaft supported by suitable bearings in the housing;
- impeller means mounted on the shaft for pumping liquid and generating a liquid head between the inlet and the outlet;
- a rotary seal mounted on at least one end of the shaft sealing the shaft with respect to the pressure housing and having a cooling jacket around it;
- a liquid reservoir space, within the pressure housing and located inboard of the mechanical seal, the pressure within the reservoir in use being substantially equal to the suction inlet pressure;
- an annular clearance space between the shaft and the pressure housing communicating at one end with the reservoir space and extending to the seal at its other end;
- duct means connecting the reservoir space and the annular clearance space immediately adjacent to the seal, such that when the pump is not running but contains high temperature liquid, a thermosyphon driven by the temperature difference between the high temperature liquid within the reservoir and the cooled seal is established, circulating liquid from the reservoir space via the annular clearance and the duct means to the reservoir again.

Thus, the solution offered by the present invention is to provide duct means whereby the thermosyphon flowpath is via an external connection to the reservoir space rather than by local convection currents within the annular clearance space, this latter condition giving rise to undesired bowing of the shaft.

The liquid reservoir space at one end of the pump will usually be constituted by the suction inlet. At the other end of the pump there is usually provided a balance drum whose function is twofold; namely to break down the high pressure within the pump generated by the impeller means to a pressure essentially equal to pump inlet pressure. The second function is to reduce the axial thrust generated in the shaft by hydraulic forces, to a net value capable of being handled by a thrust bearing.

In order to maintain the pressure at the low pressure end of the drum to essentially that of the pump suction pressure, the balance drum discharge chamber is connected to the suction inlet by means of a suitable return pipe. The balance drum discharge chamber constitutes the liquid reservoir space corresponding to that at the other end of the pump formed by the suction inlet.

The thermosyphon set up through the duct means ensures that water, at a more uniform temperature than would otherwise be the case, flows through the annular space from the liquid reservoir space, thereby minimizing any thermal stratification around the shaft. This is achieved without the use of complex additional pumps and pipework.

In the present invention, it is also preferred to minimize the cooling of the shaft by arranging the cooling jacket to be restricted to only that part of the housing immediately around the seal itself—thereby restricting the length of shaft subjected to residual stratification to the section inside the seal.

Moreover, it is preferred to provide an air gap within the housing to lessen thermal conduction from the remainder of the hot pump to the cooled seal.

It may also be desirable to fit a close clearance restriction bush around the shaft between the seal and the point at which the duct means connects into the annular clearance space. This restricts passage of hot liquid to the seal.

Moreover, an insulating sleeve may be provided between the seal and the shaft, so that any residual heat flow results in thermal distortion of the sleeve rather than the shaft.

Although it should not be necessary in most cases, a small pump can be provided in the duct means to assist the thermosyphoning recirculation.

BRIEF DESCRIPTION OF THE DRAWING

An embodiment of the present invention will now be described by way of example only with reference to the drawings wherein.

DETAILED DESCRIPTION OF THE PREFERRED EMBODIMENTS

Figure 1:
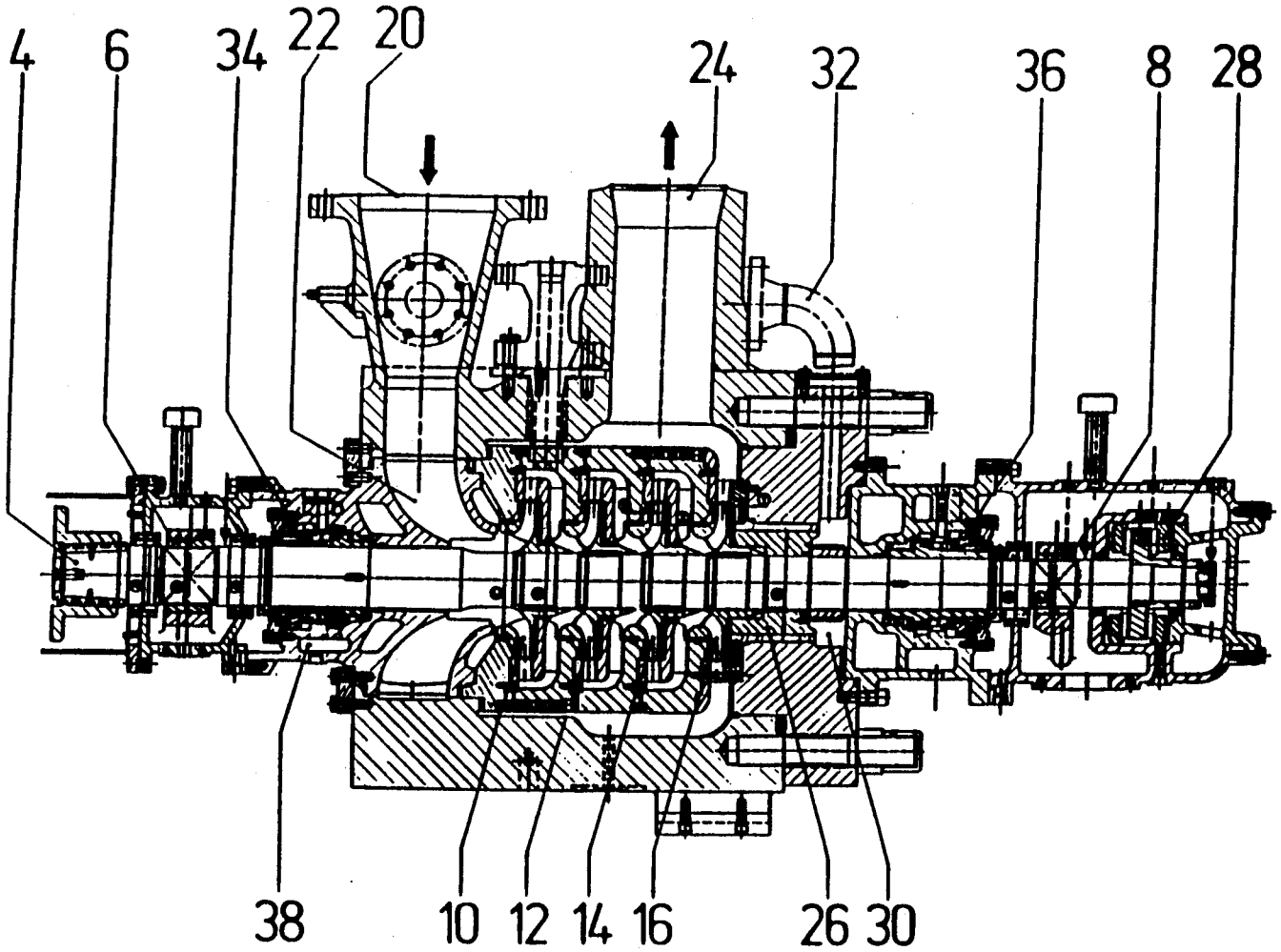
FIG. 1 is a cross sectional view of a conventional high temperature boiler feed pump.

FIG. 1 shows a conventional centrifugal multistage boiler feed pump having a pump housing 2 and shaft 4 rotatably mounted therein by drive end bearing 6 and non-drive end bearing 8. On the shaft are mounted impellers 10, 12, 14, 16, of a centrifugal multistage pump mechanism. Hot boiler feed water at an elevated temperature (e.g. 150°-160° C.) passes into suction inlet 20 and into inlet 22, from which it is pumped through the impellers and passes out under pressure through discharge outlet 24.

Feed water is progressively pressurized as it passes through the impellers, so that a net force is exerted on the shaft towards the drive end. To counteract this, a balance drum 26 and double acting tilting pad thrust bearing 28 are provided. The balance drum reduces the water pressure between the shaft and the housing such that in the balance drum space 30 the pressure is equal to the suction inlet pressure, and its proportions are determined so that there is minimal net axial thrust on the thrust bearing. To ensure equal pressure, a balance water return 32 connects the balance drum space 30 to the suction inlet 20.

A drive end seal 34 is provided around the drive end of the shaft to prevent egress of water. A non-drive end seal 36 is provided at the non-drive end of the shaft 4. These seals are mechanical seals having rubbing faces or carbon or ceramic material which are spring biased into contact with each other. The leakage rate of such seals is very low.

Figure 2:
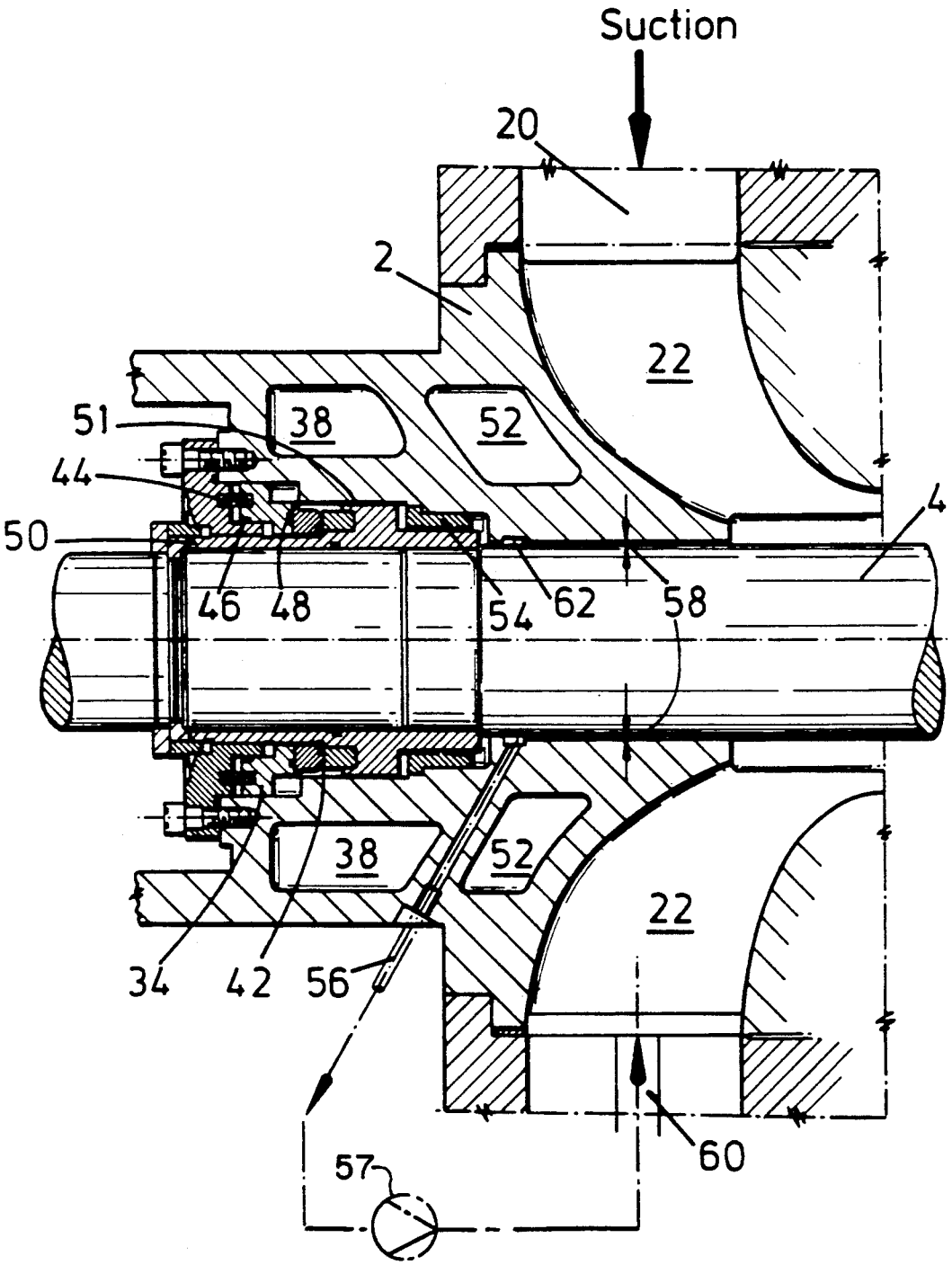
FIG. 2 is a detailed elevation of a seal assembly modified according to the present invention.

FIG. 2 shows in more detail a seal arrangement according to the present invention. The same reference numerals are used for analogous parts.

The drive end seal 34 comprises rubbing sealing surfaces 42 biased together by spring 44, and sealing O-rings 46, 48.

A seal support sleeve 50 is mounted on the shaft 4.

A screwed pumping ring 51 is provided and acts to circulate cooling water across the seal faces. In addition cold water is circulated through the enclosed cooling jacket 38 by a separate external pumped cooling system.

An air space 52 is provided in the housing to assist thermal insulation of the drive end seal 34 from the remainder of the hot pump.

A close clearance restriction bush 54 of the fixed or radially floating type is located inboard of the seal to offer a restricted passage between the hot water in the pump and that in the immediate vicinity of the seal.

A duct 56 is provided in the housing just inboard of the seal and in communication with an annular clearance space 58 between the shaft and the housing. The duct 56 is connected via a relatively wide bore tube to duct 60 communicating with inlet space 22, so that thermosyphoning can occur around this circuit.

Operation is as follows.

Whilst the pump is operational shaft 4 is rotating so that cooling water is pumped by pumping ring 51 to cool the drive end seal 34. Further cooling is provided by circulation of cold water from an external pumped cooling system to and from the enclosed cooling jacket 38. When the pump is stationary, some cooling of the seal still occurs by circulation of cold water by a separate pumped cooling system within water jacket 38, so that a temperature difference exists between the seal and the inlet space 22 in hot standby mode. In a conventional pump, this would lead to strong convection currents being set up within the annular space 58 leading to a severe temperature difference (typically 60° C.) between the top of the shaft and the bottom of the shaft. However, according to the present invention, a duct 56,60 is provided which allows thermosyphoning of water from inlet space 22 through duct 56; before being returned to inlet space 22 via duct 60. This thermosyphon arrangement ensures that hot water of substantially the same temperature is drawn from inlet space 22 evenly around annular space 58. Typically, duct 56, 60 is of diameter 2-4 centimeters. The provision of this duct has been found to reduce thermal distortion by a factor of about 10.

If desired, a local cutaway 62 may be provided at the inlet to duct 56 to assist water flow.

A pump means 57 may also be provided in duct 56 to assist in thermosyphoning if desired, however it will be understood by those skilled in the art that such is not required to create the thermosyphoning effect according to the invention.

We claim:

1. A pump suitable for high temperature liquid, comprising:

a pressure housing having a suction inlet and a discharge outlet for the liquid being pumped;

a driven shaft supported by bearings in the housing;

impeller means mounted on the shaft for pumping liquid and generating a liquid head between the inlet and the outlet;

a rotary seal mounted on at least one end of the shaft, sealing the shaft with respect to the pressure housing and having a cooling jacket around it, whereby the seal is cooled;

a liquid reservoir space within the pressure housing and located inboard of the rotary seal, the pressure within the reservoir in use being substantially equal to the suction inlet pressure;

an annular clearance space between the shaft and the pressure housing communicating at one end with the reservoir space and extending towards the seal at its other end;

duct means connecting the reservoir space and the annular clearance space immediately adjacent to the seal, such that when the pump is not running but contains high temperature liquid in the reservoir, a thermosyphon driven by a temperature difference between the high temperature liquid within the reservoir and the cooled seal is established, circulating said high temperature liquid from the reservoir space via the annular clearance space and the duct means to the reservoir again.

2. A pump according to claim 1 wherein the liquid reservoir space is the suction inlet of the pump.

3. A pump according to claim 1 or 2 wherein the cooling jacket is restricted to only that part of the housing immediately around the seal.

4. A pump according to claim 1 wherein an air gap is provided within the housing between the seal and the liquid reservoir space.

5. A pump according to claim 1 which further comprises a restriction bush around the shaft between the seal and the point at which the duct means connects into the annular clearance space.

6. A pump according to claim 1 which further comprises an insulating sleeve between the seal and the shaft.

7. A pump according to claim 1 which further comprises pump means in the duct means.

8. A pump, comprising:

a housing defining an inlet, an outlet and a reservoir space for containing liquid at a first temperature, said reservoir space communicating with the inlet to provide a liquid pressure within the reservoir space substantially equal to pressure in the inlet, said housing further defining a jacket means for cooling spaced away from said reservoir;

a driven pump shaft supported by bearings in the housing and defining an annular space between said shaft and said housing, with said annular space opening into said reservoir space;

a seal means mounted on an end of the shaft in said housing adjacent an end of said annular space opposite said reservoir space, said seal means being maintained at a second temperature lower than said first temperature by said cooling jacket means when said shaft is stationary; and means for thermosyphoning liquid at said first temperature from said reservoir space into said annular space to surround said stationary shaft and maintain said shaft at a substantially uniform temperature higher than said second temperature.

9. The pump according to claim 8 wherein said thermosyphoning means comprises a duct defined at least in part by the housing, said duct providing liquid communication between said annular space at a position adjacent said seal means and between said seal means and said reservoir space, whereby liquid at said first temperature flows from the reservoir space through the annular space to said position adjacent the seal means and returns to said reservoir via said duct.

10. The pump according to claim 9, wherein means for restricting passage of liquid is disposed around said shaft between said seal means and said position adjacent said seal means, whereby passage of liquid at said first temperature around said seal means is restricted.

11. The pump according to claim 9, wherein flow of liquid through said thermosyphoning means is caused solely due to the difference between said first and second temperatures.

12. The pump according to claim 9, wherein flow of liquid through said thermosyphoning means is assisted by means for pumping disposed in liquid communication with said duct.

* * * * *